US011185120B2

(12) United States Patent
Manni

(10) Patent No.: US 11,185,120 B2
(45) Date of Patent: Nov. 30, 2021

(54) ADJUSTMENT MECHANISM FOR ADJUSTING LENGTH OF A HEADBAND

(71) Applicant: Varjo Technologies Oy, Helsinki (FI)

(72) Inventor: Jukka Manni, Helsinki (FI)

(73) Assignee: Varjo Technologies Oy, Helsinki (FI)

( * ) Notice: Subject to any disclaimer, the term of this patent is extended or adjusted under 35 U.S.C. 154(b) by 163 days.

(21) Appl. No.: 16/796,324

(22) Filed: Feb. 20, 2020

(65) Prior Publication Data

US 2021/0259344 A1 Aug. 26, 2021

(51) Int. Cl.

| | |
|---|---|
| ***A42B 1/22*** | (2006.01) |
| ***A41D 20/00*** | (2006.01) |
| ***A42B 7/00*** | (2006.01) |

(52) U.S. Cl.

CPC ..... *A42B 1/22* (2013.01); *A41D 20/00* (2013.01); *A42B 7/00* (2013.01); *Y10T 24/2187* (2015.01)

(58) Field of Classification Search

CPC .. A42B 7/00; A42B 1/22; A42B 3/145; Y10T 24/2187; A41D 20/00

See application file for complete search history.

(56) References Cited

U.S. PATENT DOCUMENTS

| | | | | |
|---|---|---|---|---|
| 6,708,376 | B1 * | 3/2004 | Landry | A42B 3/145 2/418 |
| 9,357,811 | B2 * | 6/2016 | Chiang | A42B 3/14 |
| 9,380,824 | B2 * | 7/2016 | Ma | A42B 3/145 |
| 9,572,392 | B2 * | 2/2017 | Klotz | A42B 3/145 |
| 9,642,412 | B2 * | 5/2017 | Klotz | A42B 3/085 |
| 9,681,705 | B2 * | 6/2017 | Trudel | A43C 7/00 |
| 10,031,340 | B2 * | 7/2018 | Lai | A42B 7/00 |
| 10,156,347 | B2 * | 12/2018 | Pontano | F21V 21/084 |
| 10,357,401 | B2 * | 7/2019 | Hsu | A42B 3/085 |
| 10,543,630 | B2 * | 1/2020 | Hipwood | A43C 11/165 |
| 10,558,052 | B2 * | 2/2020 | Chang | G02B 27/0176 |
| 10,660,224 | B2 * | 5/2020 | Wen | H05K 5/0217 |
| 10,684,646 | B2 * | 6/2020 | Wang | G06F 1/163 |
| 10,873,799 | B2 * | 12/2020 | Wang | H04R 1/028 |
| 11,022,246 | B1 * | 6/2021 | Bernosky | B60P 3/34 |
| 2017/0006949 | A1 * | 1/2017 | Lacy | A42B 1/22 |
| 2017/0347736 | A1 * | 12/2017 | Penner | A42B 3/085 |
| 2020/0121017 | A1 * | 4/2020 | King | A42B 3/14 |
| 2020/0315279 | A1 * | 10/2020 | Maloney | A42B 3/145 |
| 2020/0371363 | A1 * | 11/2020 | Lin | A42B 1/22 |
| 2021/0153593 | A1 * | 5/2021 | Brooks | A42B 1/02 |
| 2021/0219647 | A1 * | 7/2021 | Gangadhar | A42B 3/145 |
| 2021/0251329 | A1 * | 8/2021 | Pasala | A42B 3/08 |

* cited by examiner

*Primary Examiner* — Robert Sandy
*Assistant Examiner* — Louis A Mercado
(74) *Attorney, Agent, or Firm* — Ziegler IP Law Group, LLC

(57) ABSTRACT

An adjustment mechanism for allowing a user to adjust a length of a headband includes a stationary case, a clutch, and a knob. The stationary case defines an opening and a circular recess. The clutch includes a cam arranged within the circular recess and a pinion extending axially from the cam such that the pinion is positioned outside the case via the opening to engage with the headband. The clutch also includes a roller located adjacent to a first cam portion of the cam. The knob has an actuating element arranged between the roller and a tab of the cam. The knob is rotatable in a first direction for allowing the user to shorten the length of the headband. The knob is rotatable in a second direction allowing the user to increase the length of the headband.

13 Claims, 8 Drawing Sheets

ADJUSTMENT MECHANISM FOR ADJUSTING LENGTH OF A HEADBAND

TECHNICAL FIELD

The present disclosure relates generally to an adjustment mechanism; and more specifically, to an adjustment mechanism for allowing a user to adjust a length of a headband.

BACKGROUND

Headbands are flexible restraining members that are used for restraining a user's head with a device, for example, a headphone. These headbands are included with one or more adjustment devices to adjust a length of the headband so that the headband secures the device to the user's head. Some examples of adjustment devices presently used include a pawl and ratchet mechanism, a detent mechanism, or sprags (forming part of a clutch mechanism) that control movement of the headband relative to the adjustment device for adjusting the length of the headband.

Noise is typically generated when such mechanisms operate, and this may be found to be unpleasant, and in some cases, irritating to the user of the device. Moreover, as components of such mechanisms typically operate step-wise i.e. in discrete amounts of movements, adjustments made to the length of the headbands are also in discrete amounts, while on the contrary, an infinitely adjustable headband would be desirable by many users.

In addition to the above, some of the aforementioned adjustment devices are also cost-intensive to manufacture. For instance, some of the aforementioned adjustment devices are known to employ one or more components, e.g. sprags, of complex design (i.e. geometry) and a manufacture of such components requires precision engineering practices to manufacture.

Therefore, in light of the foregoing discussion, there exists a need for an improved adjustment mechanism to overcome the aforementioned drawbacks associated with conventionally known adjustment devices.

SUMMARY

The present disclosure seeks to provide an adjustment mechanism for allowing a user to adjust a length of a headband. The present disclosure seeks to provide a solution to the existing problem of noisy and step-wise operation (i.e. in discrete amounts of adjustment) when adjusting the length of the headband. An aim of the present disclosure is to provide a solution that overcomes at least partially the problems encountered in prior art, and provides an adjustment mechanism that facilitates a step-less and substantially noiseless operation in the adjustment of the length of the headband.

In one aspect, an embodiment of the present disclosure provides an adjustment mechanism for allowing a user to adjust a length of a headband, the adjustment mechanism comprising:

- a stationary case defining an opening and a circular recess adjacent to the opening along a common axis;
- a clutch comprising:
- a cam arranged within the circular recess of the case and a pinion extending axially from the cam such that the pinion is positioned outside the case via the opening to engage with the headband, the cam having a first cam portion, a wedge portion, a second cam portion, and a tab arranged in a radially outward, sequential and repeated manner about the common axis;
- a roller positioned between the stationary case and the cam of the clutch such that the roller is located adjacent to the first cam portion of the cam;
- a knob having an actuating element, the actuating element positioned within the circular recess and arranged between the roller and the tab of the cam, wherein the knob is rotatable in:
- a first direction in which the actuating element is positioned adjacent to the second cam portion of the cam to allow the user to shorten the length of the headband by rotating the pinion in the first direction; and
- a second direction in which the actuating element is positioned to frictionally engage with the stationary case and the wedge portion of the cam to allow the user to increase the length of the headband by rotating the pinion in the second direction.

Embodiments of the present disclosure substantially eliminate or at least partially address the aforementioned problems in the prior art, and enable a step-less and substantially noise-less adjustment of the headband relative to a user's head.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those skilled in the art will understand that the drawings are not to scale. Wherever possible, like elements have been indicated by identical numbers.

Embodiments of the present disclosure will now be described, by way of example only, with reference to the following diagrams wherein.

Figure 1:
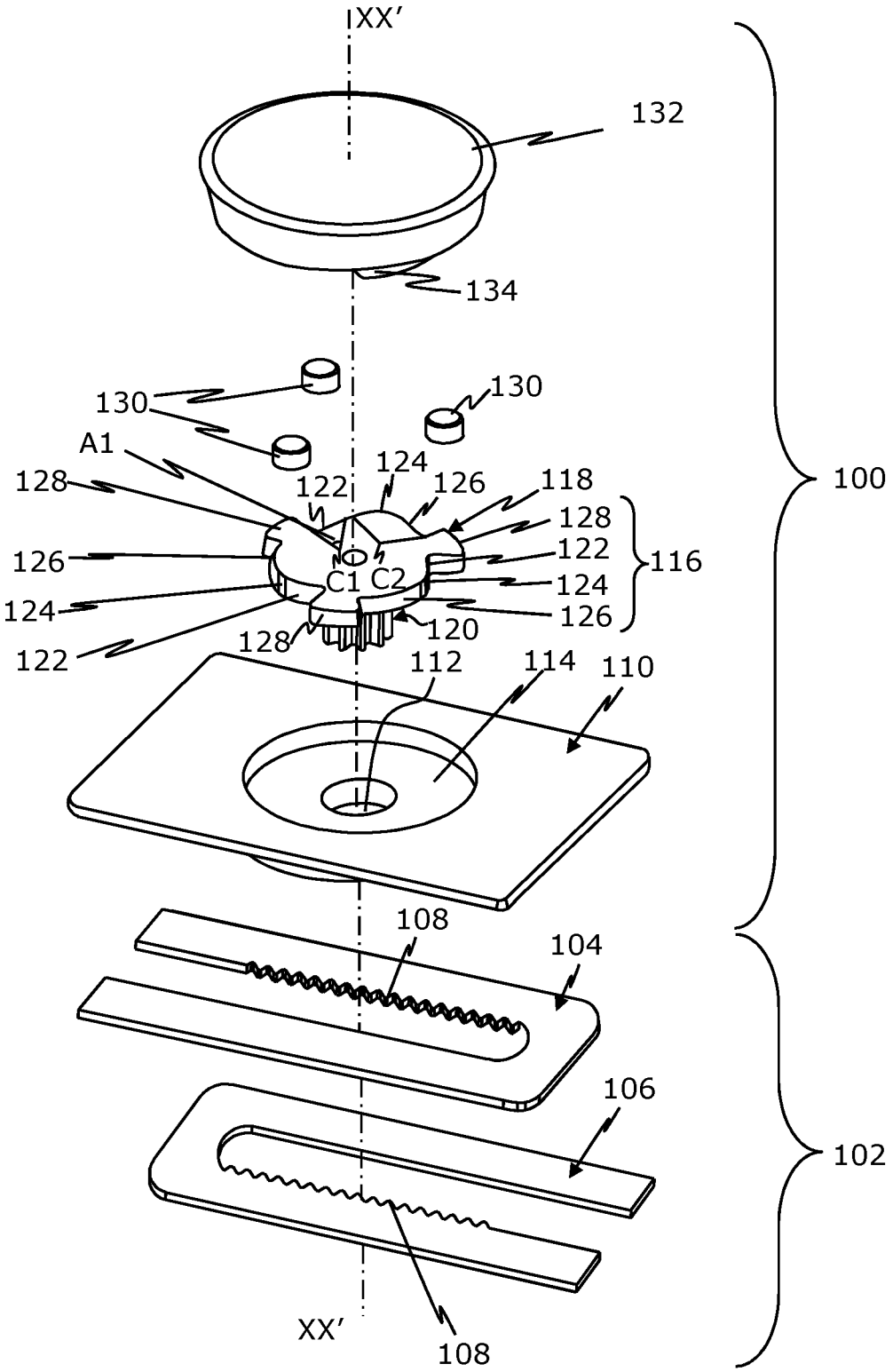
FIG. 1 is an exploded top perspective view of an adjustment mechanism for adjusting a length of a headband, in accordance with an embodiment of the present disclosure.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although some modes of carrying out the present disclosure have been disclosed, those skilled in the art would recognize that other embodiments for carrying out or practising the present disclosure are also possible.

In one aspect, an embodiment of the present disclosure provides an adjustment mechanism for allowing a user to adjust a length of a headband, the adjustment mechanism comprising:

- a stationary case defining an opening and a circular recess adjacent to the opening along a common axis;
- a clutch comprising:
- a cam arranged within the circular recess of the case and a pinion extending axially from the cam such that the pinion is positioned outside the case via the opening to engage with the headband, the cam having a first cam portion, a wedge portion, a second cam portion, and a tab arranged in a radially outward, sequential and repeated manner about the common axis;
- a roller positioned between the stationary case and the cam of the clutch such that the roller is located adjacent to the first cam portion of the cam;
- a knob having an actuating element, the actuating element positioned within the circular recess and arranged between the roller and the tab of the cam, wherein the knob is rotatable in:
- a first direction in which the actuating element is positioned adjacent to the second cam portion of the cam and allow the user to shorten the length of the headband by rotating the pinion in the first direction; and
- a second direction in which the actuating element is positioned to frictionally engage with the stationary case and the wedge portion of the cam and allow the user to increase the length of the headband by rotating the pinion in the second direction.

The present disclosure provides the aforementioned adjustment mechanism to a user for adjusting the length of the headband. As the knob can be used to rotate the clutch to indiscrete amounts, infinitesimal amounts of adjustment are possible to the length of the headband. This enhances a user's experience in allowing him or her to secure a device, for example, a virtual relative (VR) display device to his or her head using a desired length of the headband that can be achieved with use of the adjustment mechanism disclosed herein. As the knob and the clutch generate little to no noise in their respective operations, the aforementioned adjustment mechanism can be operated quietly i.e. with little to no noise by the user. This allows the user to improve concentration and/or focus on the task at hand when the user uses the adjustment mechanism for adjusting the length of the headband provided with a device, for example, a virtual reality (VR) display device.

In an embodiment, the stationary case of the adjustment mechanism may form part of the device itself. For example, the stationary case may be formed integrally with a helmet, a visor, a pair of goggles, or a pair of headphones and the like. In another embodiment, the stationary case may be of a stand-alone type that is located partway along a length of the headband. This allows flexibility to manufacturers in implementing the stationary case to suit application specific requirements based on constraints encountered in the application.

In an embodiment, the adjustment mechanism further comprises a receptacle member defining a receptacle shaped to receive the stationary case therein. The stationary case may be secured to the receptacle member using e.g. a press-fit arrangement, fasteners such as screws, rivets and the like. In a further embodiment, the receptacle member comprises a post about which the clutch is rotatably supported. Moreover, a shape of the stationary case and the receptacle member is selected to correspond with each other so that the stationary case can be received in the receptacle of the receptacle member. For example, the stationary case and the receptacle member may be generally flat or arcuate in shape.

The stationary case defines the opening and the circular recess. The circular recess is positioned adjacent to the opening along the common axis. The cam and the pinion are integrally formed with each other to form the clutch. The clutch may be formed by use of one or more manufacturing processes including, but not limited to, injection molding, shaping, extrusion, and/or die pressing.

The clutch may be positioned such that the cam of the clutch is arranged within the circular recess of the case and the pinion extends axially away from the cam to be positioned outside the case via the opening of the case for engaging with the headband. In order for the pinion to be positioned outside the case via the opening and engage with the pair of headband, a diameter of the opening is selected in relation to a diameter of the pinion to be sufficiently enough to allow the pinion to pass therethrough while minimizing any wobble of the pinion in operation. Further, the first cam portion, the wedge portion, the second cam portion, and the tab of the cam are arranged in a radially outward, sequential and repeated manner about the common axis. For example, the cam may have three first cam portions, three wedge portions, three second cam portions, and three tabs. However, in other cases, fewer i.e. at least one, or more first cam portions, wedge portions, second cam portions, and tabs may be used to produce the cam for performing functions that are consistent with the present disclosure.

In an embodiment, a centre used to angularly subtend the first cam portion is different from a centre used to angularly subtend the second cam portion.

The roller is positioned between the stationary case and the cam of the clutch such that the roller is located adjacent to the first cam portion of the cam. Further, in an embodiment, an angular range of the first cam portion is greater than or equal to a diameter of the roller. Also, in one embodiment, the roller is a cylindrical roller. In an alternative embodiment, the roller is a spherical roller.

The actuating element of the knob is positioned within the circular recess such that the actuating element is arranged between the roller and the tab of the cam. The actuating element may include, for example, a series of teeth that are radially arranged about the common axis. In a first mode of operation, the knob is rotated in a first direction e.g. in a clockwise direction during which the actuating element is positioned adjacent to the second cam portion of the cam for rotating the pinion in the first direction and allowing the user to shorten the length of the headband. In a second mode of operation, the knob is rotated in the second direction e.g. in a counter-clockwise direction during which the actuating element is positioned to frictionally engage with the stationary case and the wedge portion of the cam for rotating the pinion in the second direction and allowing the user to increase the length of the headband.

In an embodiment, upon completion of movement of the cam in the first direction, the cam is biased by the headband to move in the second direction during which the roller moves towards the wedge portion of the cam to lock-up the cam of the clutch with the stationary case. In the lock-up mode of operation, the clutch is frictionally engaged with the stationary case via the roller to prevent any inadvertent adjustment to the length of the headband. However, although the clutch is frictionally engaged with the stationary case, if the user wishes to adjust the length of the headband, the user may do so by simply pushing the headband (i.e., without needing rotation of the knob by the user) to decrease the length of the headband.

Additionally, or optionally, depending on specific requirements of an application, it can be contemplated to radially contour the first and second cam portions of the cam such that the clutch is bidirectionally lockable i.e. lockable in both—the clockwise and counter-clockwise directions with the stationary case yet releasable for further operation (of the knob) via an adjustment made to the length of the headband by the user when the user pushes or pulls the headband to increase or decrease the length of the headband respectively. Persons skilled in the art will appreciate that such a modification of radially contouring the first and second portions of the cam is possible to achieve added the above-mentioned functionality without deviating from a scope of the appended claims.

In an embodiment, the adjustment mechanism further comprises a spring element that is arranged between the roller and the tab of the cam. In a further embodiment, the spring element is integrally formed with the cam. In this embodiment, the spring element may be a cantilever spring extending radially outward from the first portion of the cam and located partway along the angular range of the first portion of the cam. Alternatively, the spring element may be a compression spring that extends from the tab of the cam towards the roller that is positioned adjacent to the first portion of the cam. With use of the spring element, it is contemplated that when the cam is biased by the headband to move in the second direction upon completion of movement of the cam in the first direction, the roller moves towards the wedge portion of the cam to lock-up the cam of the clutch with the stationary case.

It may be noted that although a cantilever spring is disclosed herein, other types of spring elements including, but not limited to, the compression spring (similar to that typically found in a sprag clutch) may be employed in lieu of the cantilever spring. Therefore, a type or configuration of the spring element used in the clutch is non-limiting of the present disclosure. Persons skilled in the art will recognize that many variations, alternatives, and modifications can be made to realize the spring element and to implement functions of the spring element that are consistent with the present disclosure.

In an embodiment, the adjustment mechanism is employed in adjusting the length of the headband in one of: a helmet, a visor, a pair of goggles, a pair of headphones, or a virtual reality (VR) display device. As such, in an embodiment, the stationary case is formed integrally with the device. Alternatively, the stationary case may be attached to the device.

In another embodiment, the headband may be a unitary headband or a multi-piece headband comprising a pair of straps. In a further embodiment, the headband is configured to have a rack that is arranged to co-operate with the pinion of the clutch.

Embodiments of the present disclosure are also directed to the device comprising a headgear, at least one flexible restraining member e.g. the headband coupled to the headgear in which the device employs the adjustment mechanism for adjusting the length of the at least one flexible restraining member.

DETAILED DESCRIPTION OF THE DRAWINGS

Figure 2:
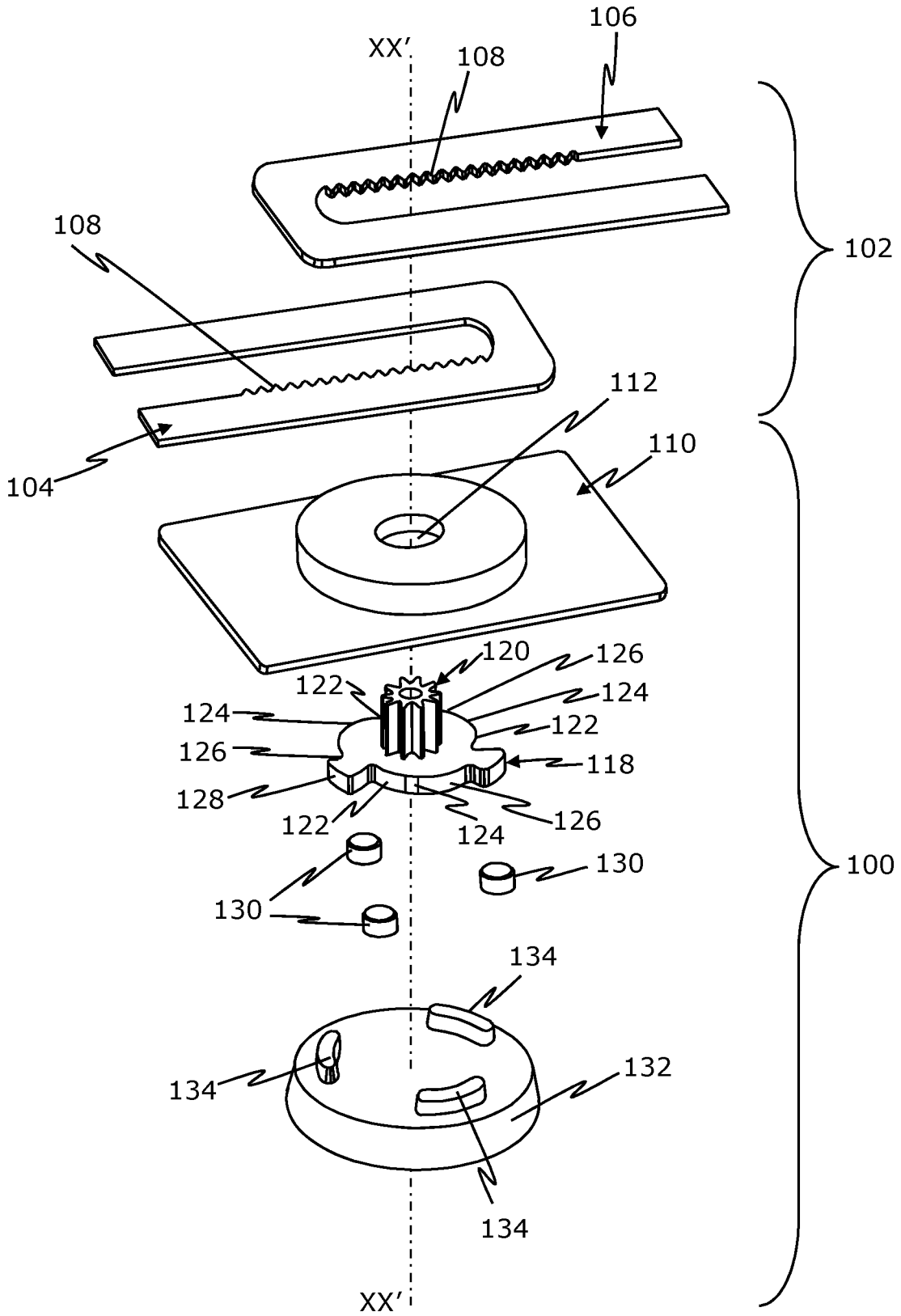
FIG. 2 is an exploded bottom perspective view of an adjustment mechanism for adjusting the length of the headband, in accordance with an embodiment of the present disclosure.

Referring to FIGS. 1 and 2, illustrated are exploded top and bottom perspective views of an adjustment mechanism 100 for adjusting a length of a headband 102, in accordance with an embodiment of the present disclosure. As shown, the headband 102 is a multi-piece headband comprising a pair of straps 104, 106. Each strap 104, 106 has a rack 108 defined thereon.

The adjustment mechanism 100 comprises a stationary case 110 defining an opening 112 and a circular recess 114 adjacent to the opening 112 along a common axis XX'. As shown, the opening 112 is a circular opening. The adjustment mechanism 100 also includes a clutch 116. The clutch 116 comprises a cam 118 arranged within the circular recess 114 of the case 110. The clutch 116 also has a pinion 120 that extends axially from the cam 118 such that the pinion 120 is positioned outside the case 110 via the opening 112 to engage with the headband 102 i.e., with the racks 108 from the pair of straps 104, 106.

The cam 118 has a first cam portion 122, a wedge portion 124, a second cam portion 126, and a tab 128 arranged in a radially outward, sequential and repeated manner about the common axis XX'. Moreover, as shown best in the view of FIG. 1, a centre C1 used to angularly subtend the first cam portion 122 is different (i.e. located in a different position) from a centre C2 used to angularly subtend the second cam portion 126.

The clutch 116 also includes a roller 130 that is located within the circular recess 114. The roller 130 is positioned between the stationary case 110 and the cam 118 of the clutch 116 such that the roller 130 is located adjacent to the first cam portion 122 of the cam 118. Further, an angular range A1 of the first cam portion 122 is greater than or equal to a diameter D of the roller 130. In the views of FIGS. 1 and 2, three rollers 130 are exemplarily shown to correspond with the three first cam portions 122 of the cam 118. Moreover, each roller 130 is implemented by way of a cylindrical roller (pin).

The adjustment mechanism 100 also comprises a knob 132 having an actuating element 134. The actuating element 134 is positioned within the circular recess 114 and arranged between the roller 130 and the tab 128 of the cam 118. In the views of FIGS. 1 and 2, three actuating elements 134 are exemplarily shown to correspond with the three tabs 128 of the cam 118 and the three rollers 130.

Figure 3:
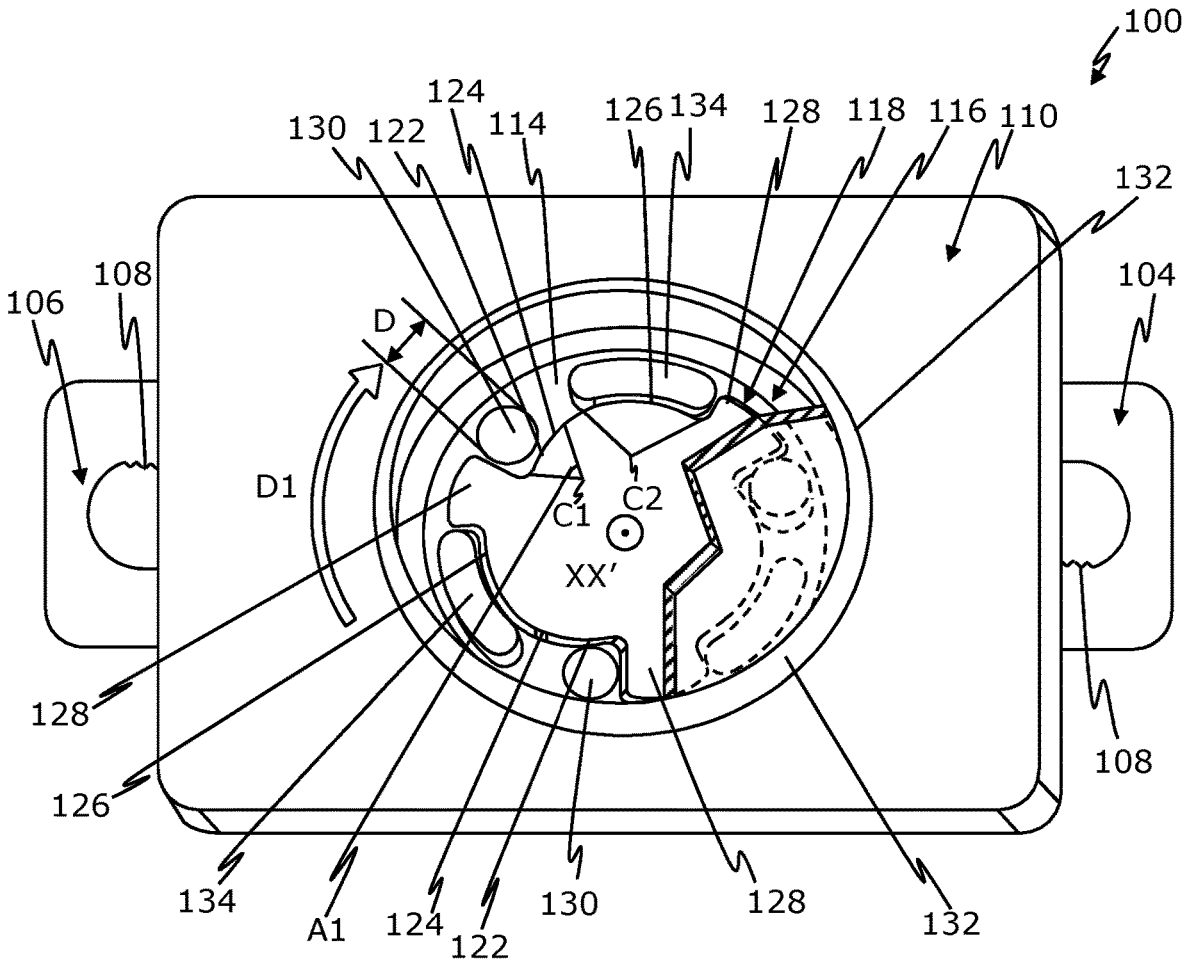
FIG. 3 is top breakaway view of the adjustment mechanism in a first mode of operation, in accordance with an embodiment of the present disclosure.
Figure 4:
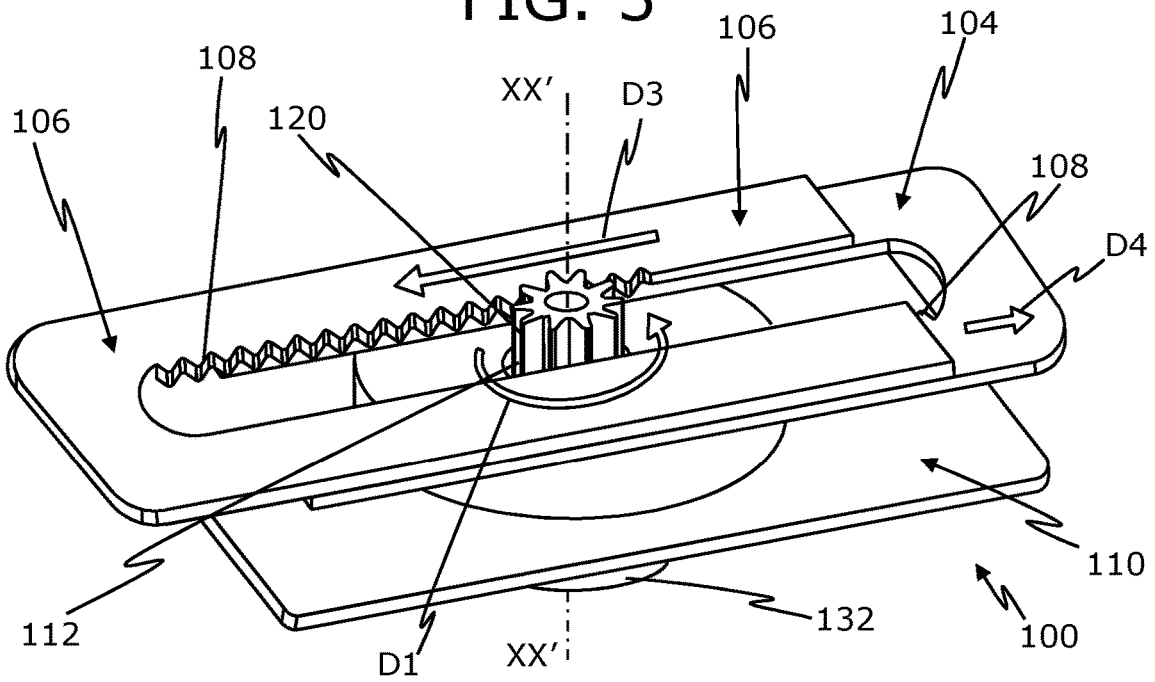
FIG. 4 is a rear perspective view of the adjustment mechanism in the first mode of operation, in accordance with an embodiment of the present disclosure.

Referring to FIGS. 3 and 4, the adjustment mechanism 100 is shown in a first mode of operation. In this mode of operation, the knob 132 is rotated in a first direction D1 e.g. a clockwise direction in which the actuating element 134 is positioned adjacent to the second cam portion 126 of the cam 118 for rotating the pinion 120 in the first direction D1 i.e., the clockwise direction and for allowing the user to shorten the length of the headband 102 i.e., an individual length of each strap 104, 106 by moving the racks 108 of the individual straps 104, 106 towards each other, or stated differently, in directions facing each other (as indicated by the arrows D3 and D4 respectively).

Figure 5:
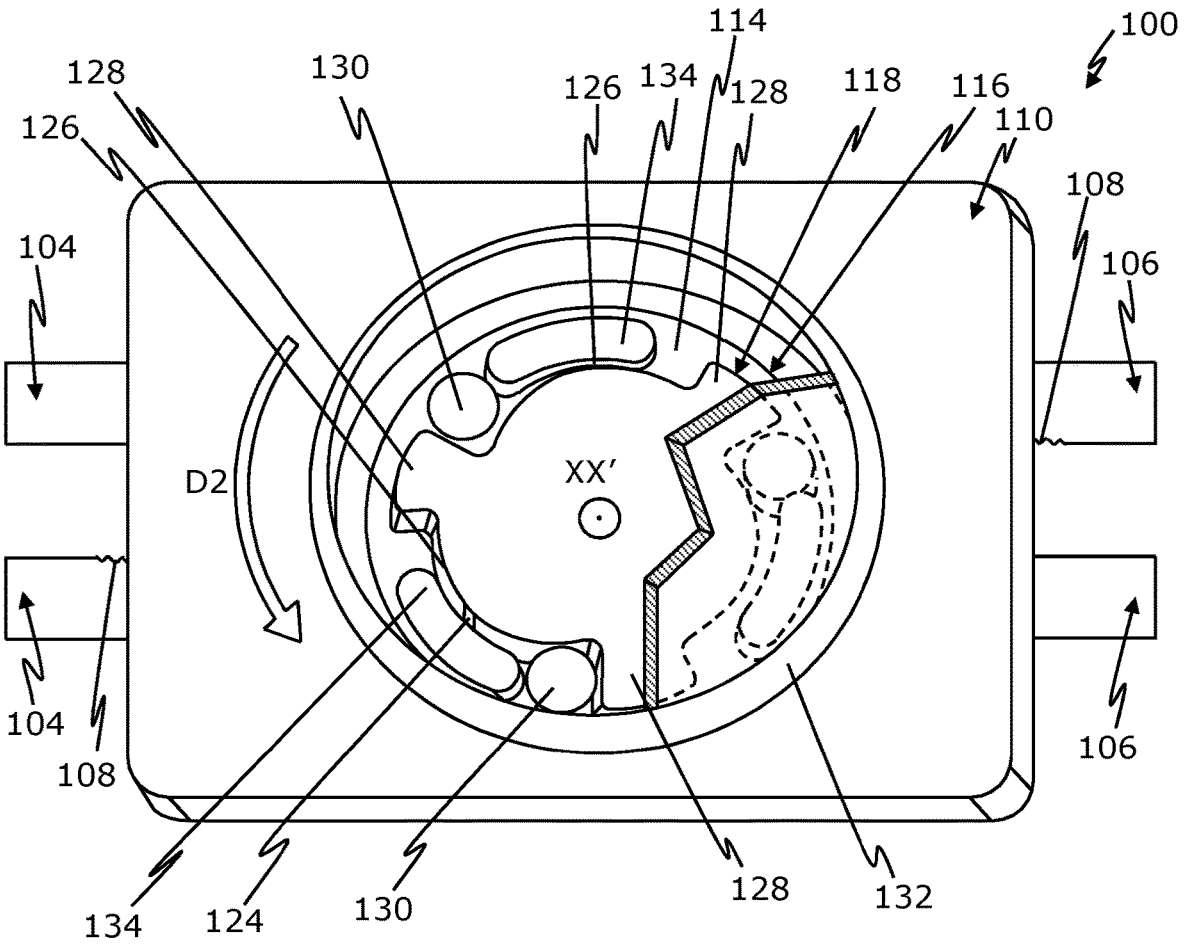
FIG. 5 is a breakaway top perspective view of the adjustment mechanism in a second mode of operation, in accordance with an embodiment of the present disclosure.
Figure 6:
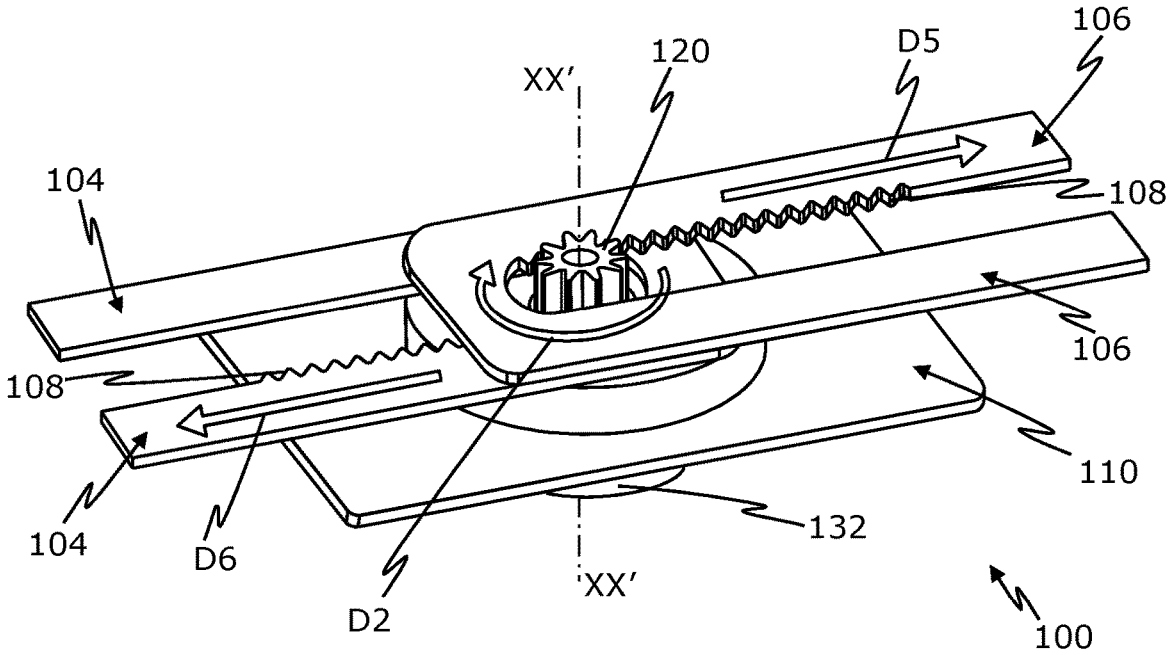
FIG. 6 is a rear perspective view of the adjustment mechanism in the second mode of operation, in accordance with an embodiment of the present disclosure.

Referring to FIGS. 5 and 6, the adjustment mechanism 100 is shown in a second mode of operation. In this mode of operation, the knob 132 is rotated in a second direction D2 e.g. a counter-clockwise direction in which the actuating element 134 is positioned to frictionally engage with the stationary case 110 and the wedge portion 124 of the cam 118 for rotating the pinion 120 in the second direction D2 i.e., the counter-clockwise direction and for allowing the user to increase the length of the headband 102 i.e., the individual length of each strap 104, 106 by moving the racks 108 of the individual straps 104, 106 away from each other, or stated differently, in directions opposing each other (as indicated by the arrows D5 and D6 respectively).

Figure 7:
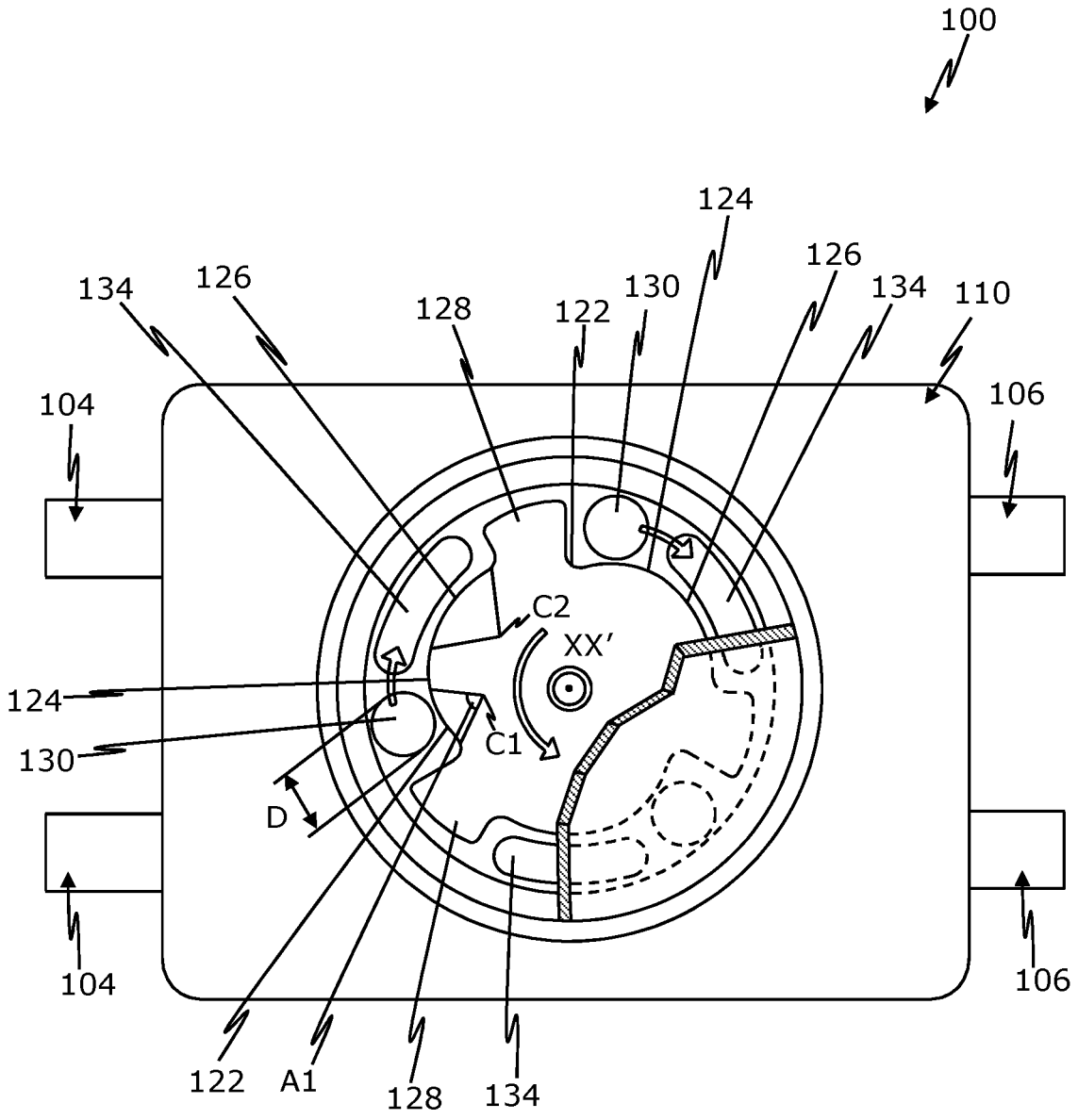
FIG. 7 is a front view of the adjustment mechanism in breakaway during a lock-up mode of operation, in accordance with an embodiment of the present disclosure.

Referring to FIG. 7, a front view of the adjustment mechanism 100 is illustrated, in breakaway, during a lock-up mode of operation. Upon completion of movement of the cam 118 in the first direction D1 (e.g. the clockwise direction shown in FIG. 3), the cam 118 is biased by the headband 102, via the pinion 120, (partly due to forces developed in the headband 102 when the headband 102 is tightened around the user's head) to move in the opposite direction, (i.e. the second direction D2 or e.g. the counter-clockwise direction shown in FIG. 4). During this time, the roller 130 moves towards the wedge portion 124 of the cam 118 to lock-up the cam 118 of the clutch 116 with the stationary case 110 and prevent any inadvertent adjustment of the length of the headband 102. It may be noted that in order to realize the lock-up mode, the cam 118 executes, under bias by the headband 102, a significantly less angle of rotation in the second direction D2 (e.g. the counter-clockwise direction) as compared to an angle of rotational movement brought about in the first direction D1 (e.g. the clockwise direction) previously i.e. under the effect of force applied by the user on the knob 132 of the adjustment mechanism 100. Once the roller 130 has moved towards the wedge portion 124 of the cam 118, the cam 118 of the clutch 116 is locked-up in position with the stationary case 110 and any inadvertent adjustment to the length of the headband 102 is prevented.

Figure 8:
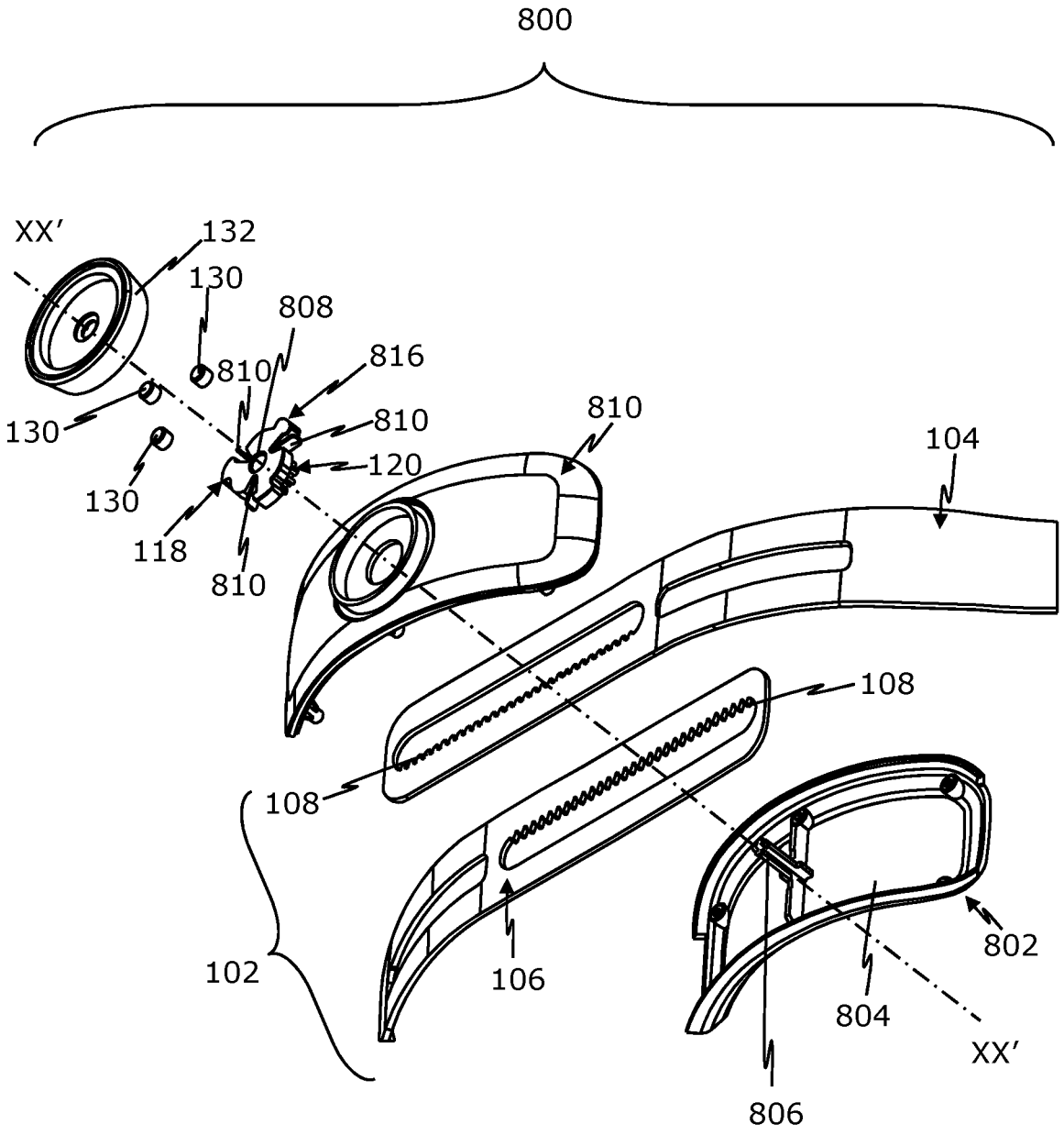
FIG. 8 is an exploded rear view of an adjustment mechanism showing an arcuate receptacle member, an arcuate stationary case, and a spring loaded clutch in which a spring element is located on a first cam portion of a cam of the clutch, in accordance with another embodiment of the present disclosure.

Referring to FIG. 8, illustrated is an exploded rear view of an adjustment mechanism 800, in accordance with another embodiment of the present disclosure. The adjustment mechanism 800 has an arcuately shaped stationary case 810. Further, the adjustment mechanism 800 also has an arcuately shaped receptacle member 802 defining a receptacle 804 that is configured to receive the arcuately shaped stationary case 810 therein. The stationary case 810 is configured to be secured to the receptacle member 802 using, for example, a press-fit arrangement or fasteners (not shown) such as, but not limited to, screws, rivets and the like.

Further, the receptacle member 802 also comprises a post 806 about which a spring-loaded clutch 816 is rotatably supported. For purposes of simplicity and brevity, the spring-loaded clutch 816 is hereinafter referred to as 'the clutch' and denoted using identical reference numeral '816'. This clutch 816 is also configured to define a passage 808 for receiving the post 806 therein.

Figure 9:
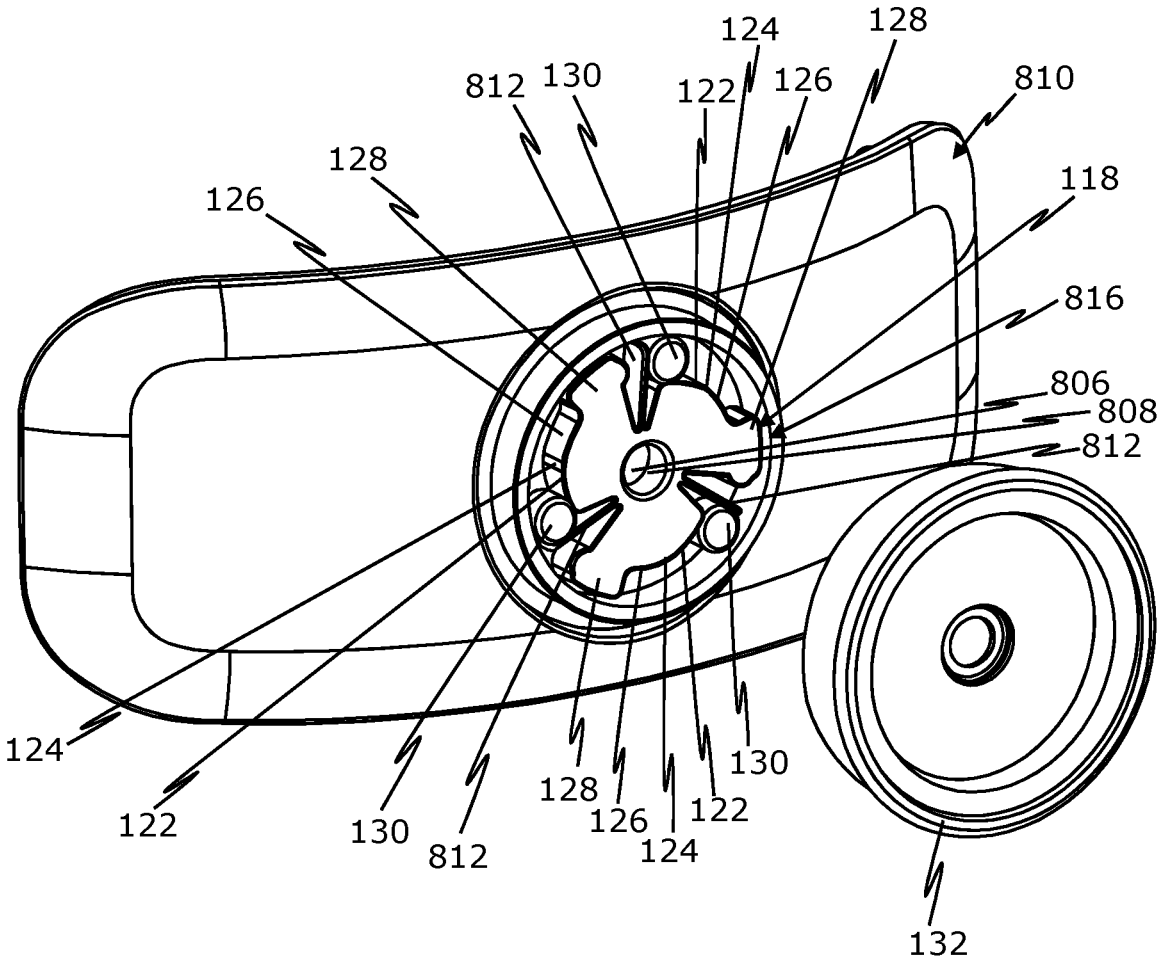
FIG. 9 is a side perspective view of the spring loaded clutch positioned within a recess of the arcuate stationary case, in accordance with another embodiment of the present disclosure.
Figure 10:
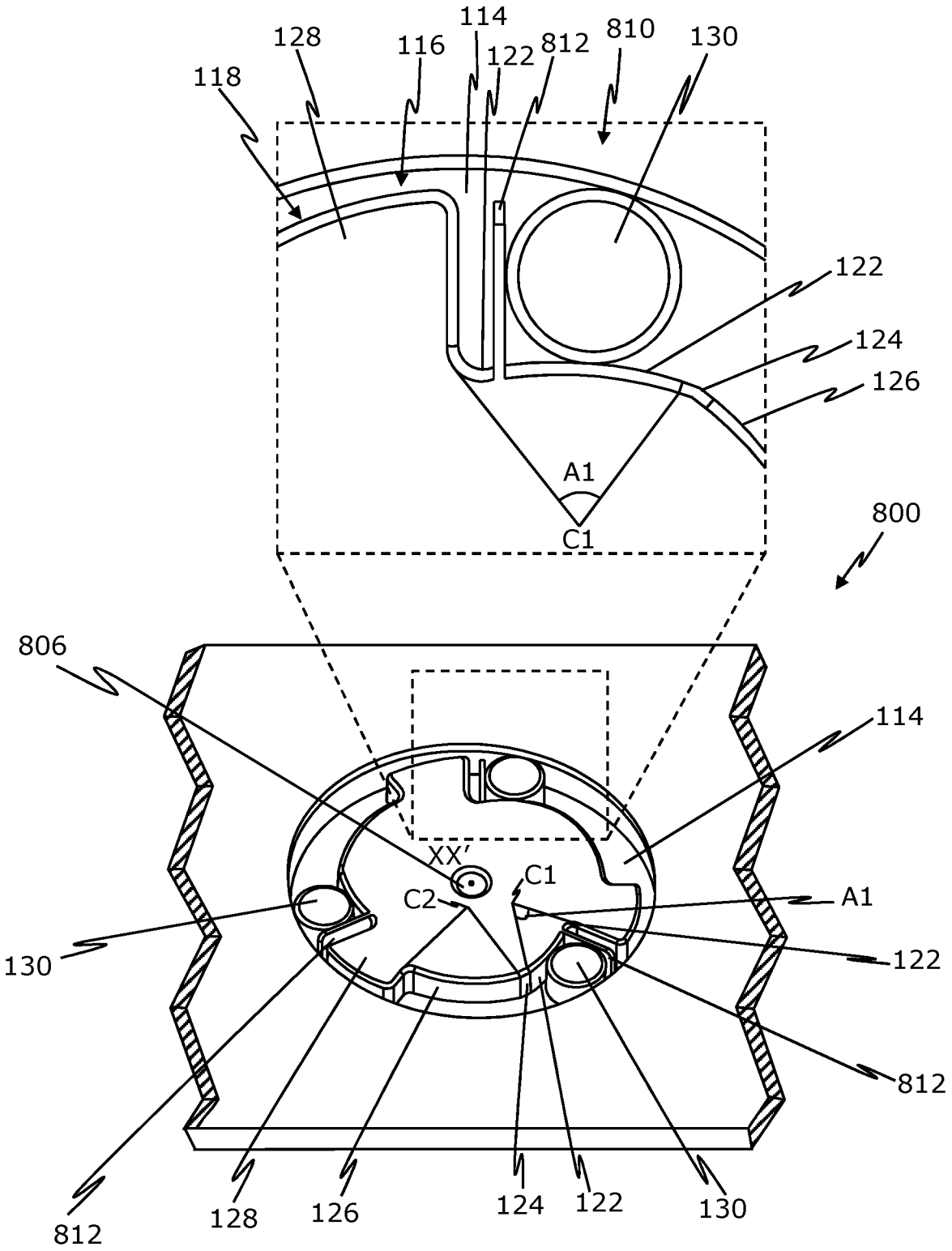
FIG. 10 is a breakaway top perspective view of the adjustment mechanism having the spring loaded clutch and showing, in magnification, the spring element for limiting a movement of a roller, in accordance with another embodiment of the present disclosure.

Referring to FIG. 9, illustrated is a side perspective view of the clutch 816 positioned within the recess 114 of the arcuate stationary case 810 while in FIG. 10, illustrated is a breakaway top perspective view of the adjustment mechanism 800 having the clutch 816 and showing, in magnification, a spring element 812 for limiting a movement of the roller 130. As shown in the views of FIGS. 9 and 10, the clutch 816 is of a spring-loaded type in which the spring element 812 is located on the first cam portion 122 of the cam 118 of the clutch 816. As shown, the spring element 812 is arranged between the roller 130 and the tab 128 of the cam 118. Moreover, the spring element 812 is integrally formed with the cam 118. Further, the spring element 812 is a cantilever spring extending radially outward from the first cam portion 122 of the cam 118 and is located partway along the angular range A1 of the first cam portion 122 of the cam 118.

It will be understood by persons skilled in the art that FIGS. 1 through 7 and FIGS. 8 through 10 illustrate simplified configurations of the adjustment mechanisms 100 and 800 for sake of clarity alone, and such simplified configurations of the adjustment mechanisms 100 and 800 should not unduly limit the scope of the claims herein. In fact, upon perusal of the present disclosure, persons skilled in the art will recognize many variations, alternatives, and modifications of embodiments of the present disclosure. Further, features disclosed in one embodiment may be combined with one or more features disclosed in another embodiment.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

What is claimed is:

1. An adjustment mechanism for allowing a user to adjust a length of a headband, the adjustment mechanism comprising:

a stationary case defining an opening and a circular recess adjacent to the opening along a common axis;

a clutch comprising:

a cam arranged within the circular recess of the case and a pinion extending axially from the cam such that the pinion is positioned outside the case via the opening to engage with the headband, the cam having a first cam portion, a wedge portion, a second cam portion, and a tab arranged in a radially outward, sequential and repeated manner about the common axis;

a roller positioned between the stationary case and the cam of the clutch such that the roller is located adjacent to the first cam portion of the cam;

a knob having an actuating element, the actuating element positioned within the circular recess and arranged between the roller and the tab of the cam, wherein the knob is rotatable in:

a first direction in which the actuating element is positioned adjacent to the second cam portion of the cam to allow the user to shorten the length of the headband by rotating the pinion in the first direction; and a second direction in which the actuating element is positioned to frictionally engage with the stationary case and the wedge portion of the cam to allow the user to increase the length of the headband by rotating the pinion in the second direction.

2. The adjustment mechanism of claim 1, wherein a centre used to angularly subtend the first cam portion is different from a centre used to angularly subtend the second cam portion.

3. The adjustment mechanism of claim 1, wherein an angular range of the first cam portion is greater than or equal to a diameter of the roller.

4. The adjustment mechanism of claim 1, wherein upon completion of movement of the cam in the first direction, the cam is biased by the headband to move in the second direction during which the roller moves towards the wedge portion of the cam to lock-up the cam of the clutch with the stationary case.

5. The adjustment mechanism of claim 1, further comprising a spring element arranged between the roller and the tab of the cam.

6. The adjustment mechanism claim 5, wherein the spring element is integrally formed with the cam.

7. The adjustment mechanism of claim 5, wherein the spring element is a cantilever spring extending radially outward from the first cam portion of the cam and located partway along an angular range of a first portion of the cam.

8. The adjustment mechanism of claim 1, wherein the headband is a unitary headband or a multi-piece headband comprising a pair of straps.

9. The adjustment mechanism of claim 1, wherein the headband is configured to have a rack that is arranged to co-operate with the pinion of the clutch.

10. The adjustment mechanism of claim 1, wherein the roller is one of: a spherical roller or a cylindrical roller.

11. The adjustment mechanism of claim 1, further comprising a receptacle member defining a receptacle shaped to receive the stationary case therein.

12. The adjustment mechanism of claim 11, wherein the receptacle member comprises a post about which the clutch is rotatably supported.

13. The adjustment mechanism of claim 1, wherein the stationary case is one of: formed integrally, or attached to, a device.

* * * * *